United States Patent [19]

Hultqvist

[11] Patent Number: 4,644,615

[45] Date of Patent: Feb. 24, 1987

[54] LOCK FOR SAFETY BELTS

[75] Inventor: Lars Hultqvist, Västra Frölunda, Sweden

[73] Assignee: Broderna Holmbergs Fabriks AB, Anderstorp, Sweden

[21] Appl. No.: 714,632

[22] Filed: Mar. 21, 1985

[30] Foreign Application Priority Data

Mar. 22, 1984 [SE] Sweden ..... 8401591

[51] Int. Cl.[4] ..... A44B 11/26

[52] U.S. Cl. ..... 24/574; 24/631; 24/641

[58] Field of Search ..... 24/630–633, 24/574, 640, 641, 643; 280/801; 297/468

[56] References Cited

U.S. PATENT DOCUMENTS

| | | | |
|---|---|---|---|
| 2,393,178 | 1/1946 | Manson | 24/632 |
| 2,407,715 | 9/1946 | Manson | 24/630 X |
| 2,832,120 | 4/1958 | Jayet | 24/632 |
| 3,587,141 | 6/1971 | Brown | 24/632 |
| 3,591,902 | 7/1971 | Lohr | 24/632 |

FOREIGN PATENT DOCUMENTS

| | | | |
|---|---|---|---|
| 1083659 | 6/1960 | Fed. Rep. of Germany | 24/631 |
| 8230071 | 9/1983 | Fed. Rep. of Germany . | |
| 1173348 | 2/1959 | France | 24/631 |
| 1340006 | 9/1963 | France | 24/631 |
| 2116673 | 7/1972 | France . | |
| 2116541 | 7/1972 | France . | |
| 1078262 | 8/1967 | United Kingdom . | |

*Primary Examiner*—Kenneth J. Dorner
*Assistant Examiner*—James R. Brittain
*Attorney, Agent, or Firm*—Merchant, Gould, Smith, Edell, Welter & Schmidt

[57] ABSTRACT

Lock for safety belts, comprising a lock housing enclosing a lock mechanism having a release member for manual operation, and a member of lock tongues which can be inserted into the lock housing for co-operation with the lock mechanism. The lock mechanism comprises a number of lock plates one for each lock tongue, which are mounted in the lock housing for rotation about a common axis and each form an abutment for the associated lock tongue and a hook for retaining locking engagement with the lock tongue and are spring-biased to be engaged with the lock tongue against the spring bias when the lock tongue is inserted into the lock housing to be engaged with the abutment, an arresting element which can be actuated manually to be engaged with each lock plate to arrest temporarily the lock plate in the engaged position, and a latch member which is spring-biased to engage the lock plates when all lock plates are arrested in the engaged position, to retain permanently the lock plates in said position.

11 Claims, 16 Drawing Figures

LOCK FOR SAFETY BELTS

Figure 1:
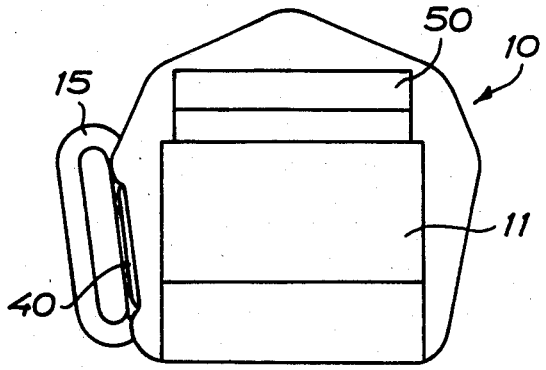

The invention relates to a lock for safety belts having at least two hip strap portions and at least one further strap portion.

When safety belts of this type are used as vehicle belts for children the safety belt comprises, in addition to the two hip strap portions attached one at each side of the seat, also two shoulder strap portions which are attached behind the seat, and possibly also a fifth strap portion which is attached below in front of the seat and is extended upwards between the legs of the user. The invention relates particularly to vehicle safety belts of this type with or without said fifth strap portion.

A safety belt having five strap portions is shown and described in the French patent specification No. 2,116,541. In that case, all strap portions are provided with lock tongues which can be inserted into a lock housing including a lock mechanism for co-operation with the lock tongues. Externally of the lock housing, there is provided a release member for manual operation which can be operated stepwise in order to release the lock tongues of the shoulder straps and to release the lock tongue of one hip strap portion and the lock tongue of the strap portion extended upwards between the legs.

It has been noticed that one lock tongue or the other of such a lock can be inserted into the lock housing without being lockingly engaged by the lock mechanism. If this is the case, the vehicle belt does not, of course, provide the intended protection for the user, and in fact there may be involved a risk of serious injuries to the user if an accident should occur when one lock tongue or the other is not engaged. In order to eliminate this risk the authorities concerned in some countries have decreed that it should be indicated, when the vehicle belt is put into use, that all lock tongues are engaged with the lock mechanism.

The German utility model registration No. G 82 30 071.2 shows and describes a belt lock which satisfies said requirements. The lock is arranged such that the lock housing is attached to one hip strap portion and that a lock tongue is attached to the other hip strap portion for co-operation with the lock housing. The two shoulder strap portions are provided with fittings which are passed onto projections on the lock housing and/or the lock tongue and are retained on these projections by the lock housing and the lock tongue being lockingly engaged. Thus, it is possible to see directly from the outside if the two shoulder strap portions are connected when the lock tongue and the lock housing are engaged. However, this prior art lock has the drawback that it may be rather cumbersome to connect the shoulder strap portions, since it is necessary to pass said portions manually onto the projection or projections and to retain them there while the lock housing and the lock tongue are being lockingly engaged.

It is the purpose of the invention to provide a lock of a construction which is not too complicated and satisfies the safety requirements now applied and at the same time can be easily handled when used.

This and other purposes of the invention, which will appear from the description which follows, are achieved by the lock for safety belts having at least two hip strap portions and at least one further strap portion, said lock including a lock housing to be attached to one hip strap portion; a lock mechanism enclosed by said casing and having a release member for manual operation; and a lock tongue on each of the other hip strap portion and said further strap portion, or each further strap portion, respectively, which can be inserted into the lock housing for co-operation with the lock mechanism, said lock mechanism comprising a number of lock plates one for each lock tongue, which are mounted in the lock housing for rotation about a common axis and each form an abutment for the associated lock tongue and a hook for retaining locking engagement with the lock tongue and are spring-biased to be engaged with the lock tongue against the spring bias when the lock tongue is inserted into the lock housing to be engaged with the abutment, an arresting element which can be actuated manually to be engaged with each lock plate to arrest temporarily the lock plate in the engaged position, and a latch member which is spring-biased to engage the lock plates when all lock plates are arrested in the engaged position, to retain permanently the lock plates in said position, the latch member being actuated by the release member against the spring bias acting on the latch member, to release the lock plates and allow rotation thereof under the spring bias acting on the lock plates, to release the respective lock tongues from the lock housing.

When such a lock is being used, the lock tongues, when they are inserted into the lock housing one after the other, will be retained in the lock housing as long as the arresting element is kept operated. However, the latch member will not snap to engaged position to retain permanently the lock tongues in the lock housing until all lock tongues have been inserted into the lock housing and have been temporarily arrested therein. The click noticed when the latch member snaps to engaged position thus indicates that all lock tongues are now safely locked in the lock housing and are not merely loosely inserted therein.

Figure 2:
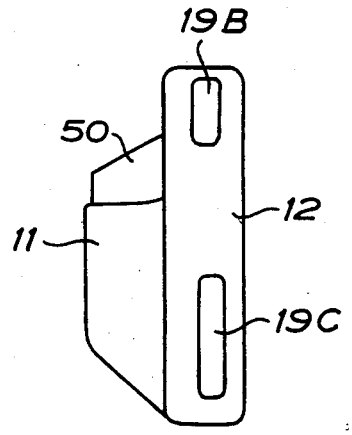
Figure 3:
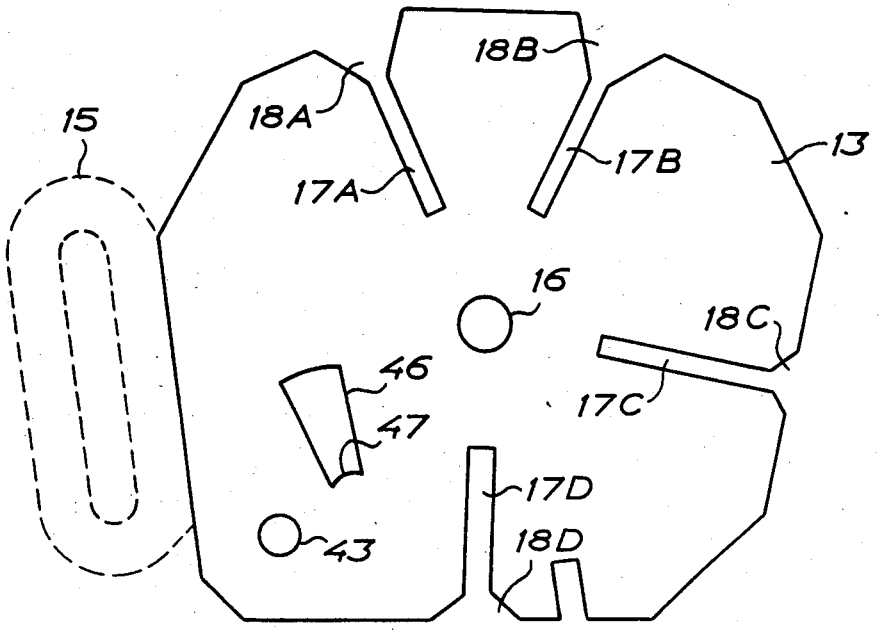
Figure 4:
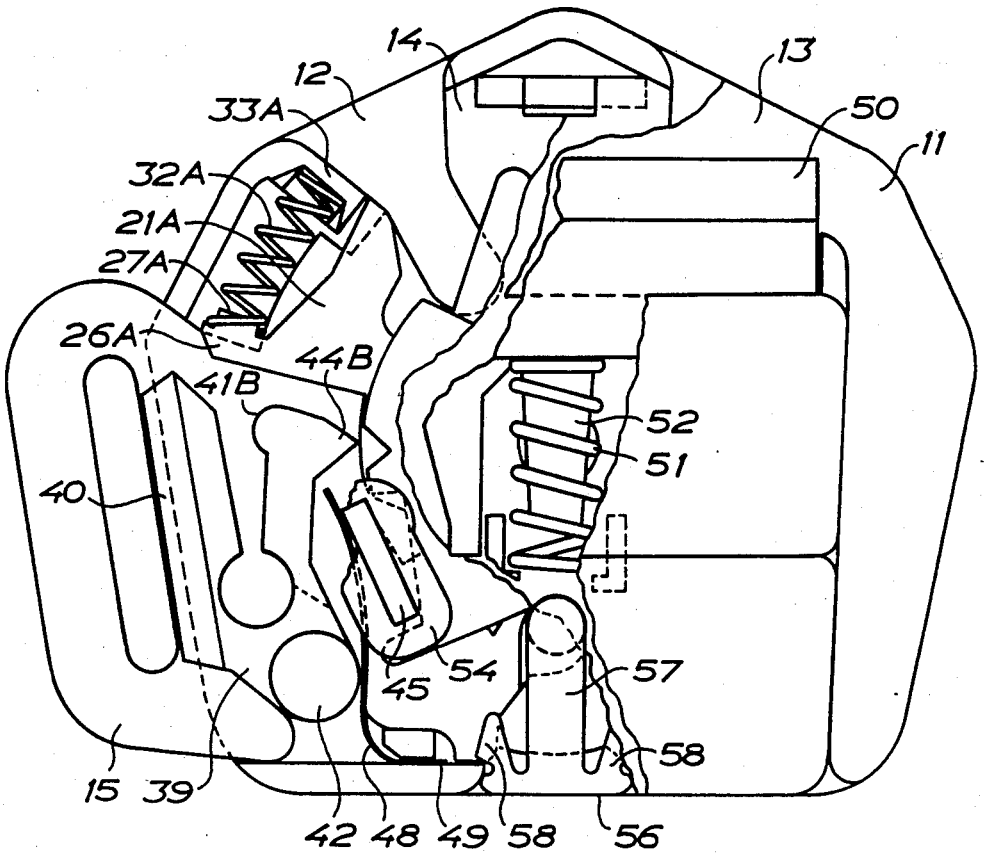
Figure 6:
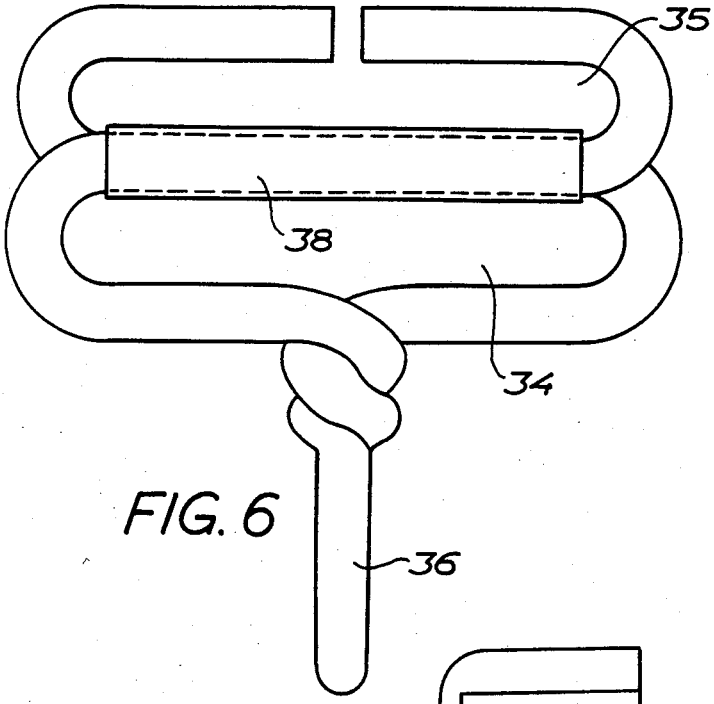
Figure 7:
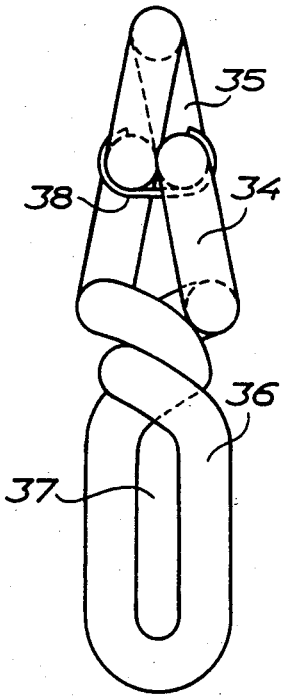
Figure 5:
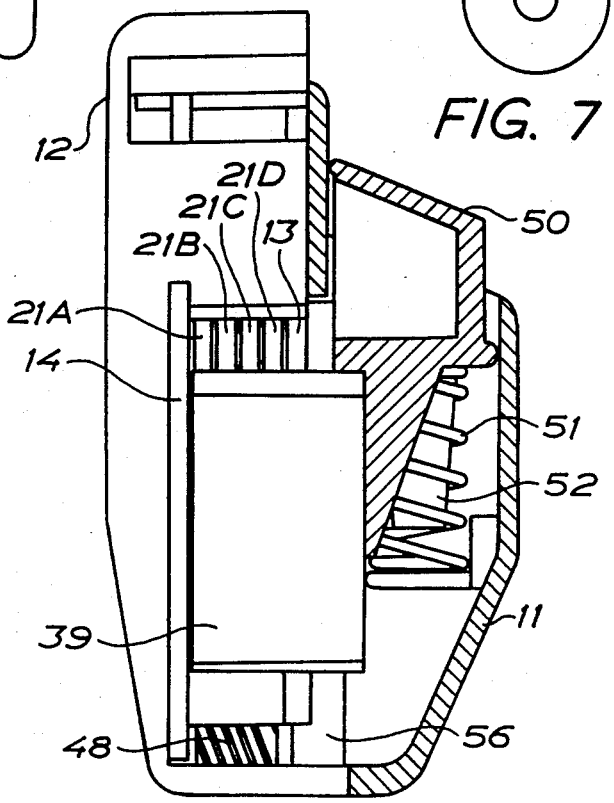
Figure 8:
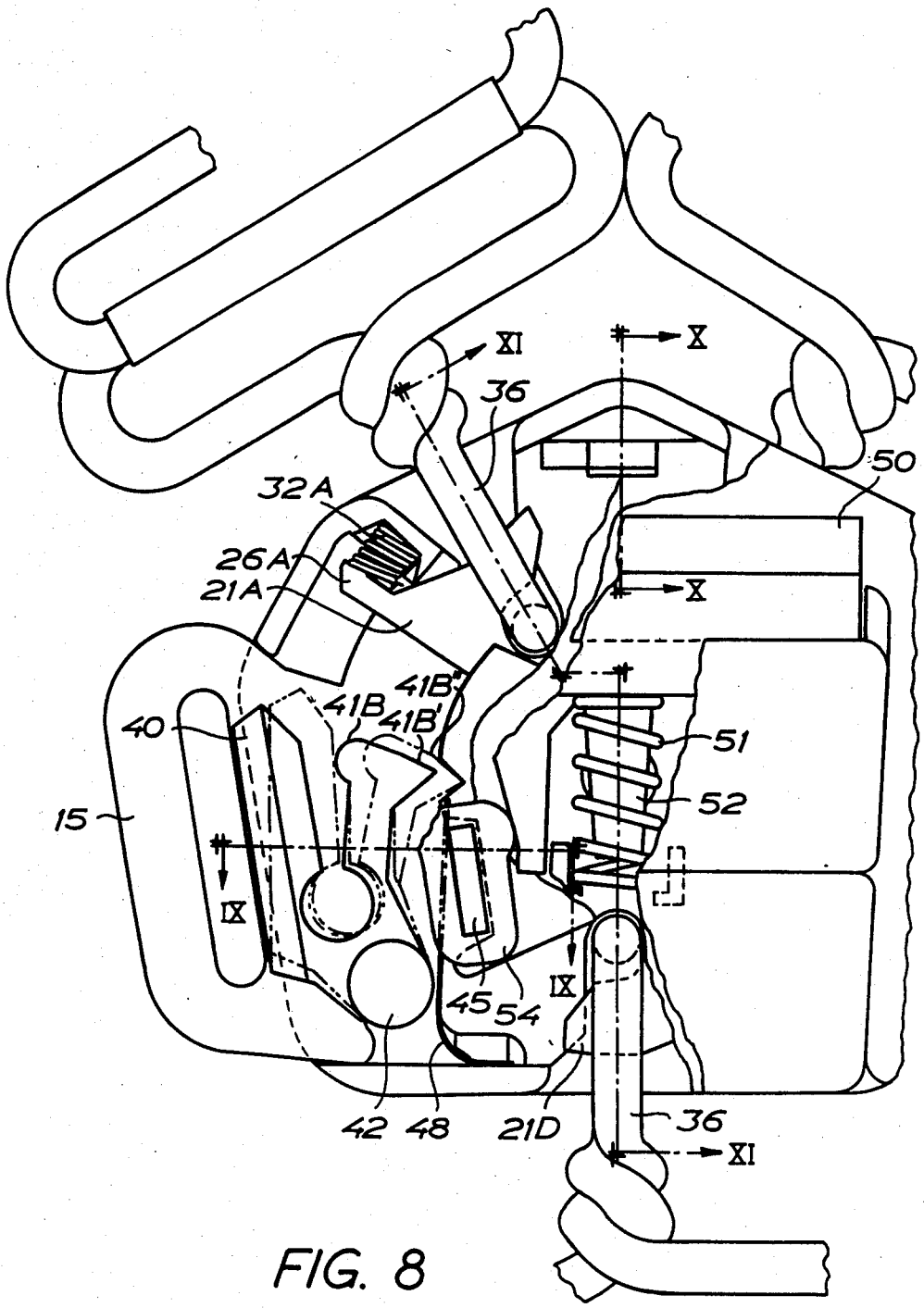
Figure 9:
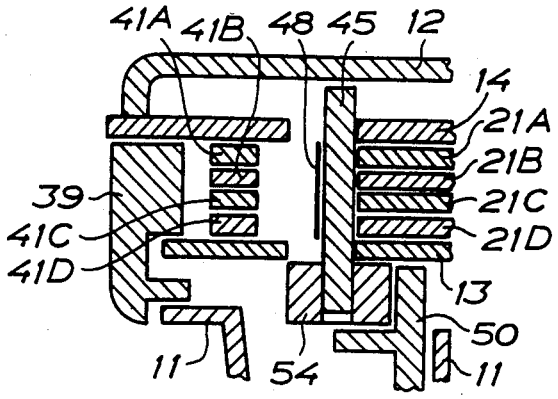
Figure 10:
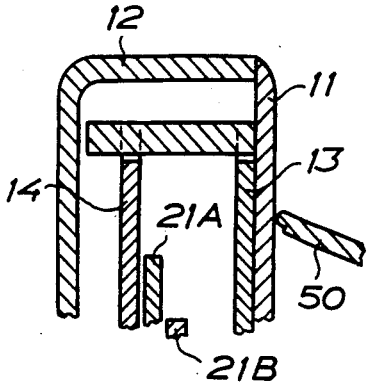
Figure 11:
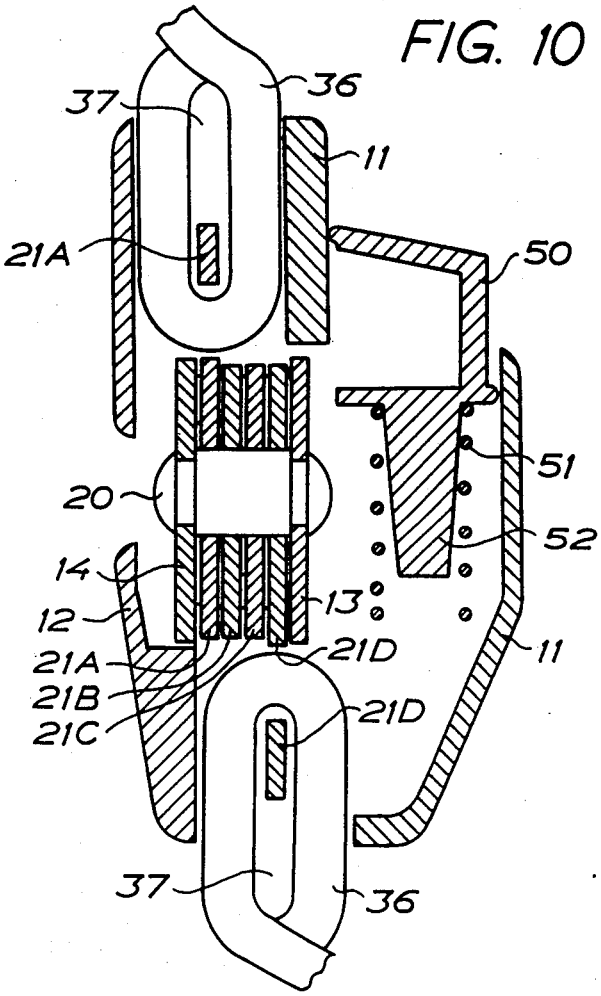
Figure 12A:
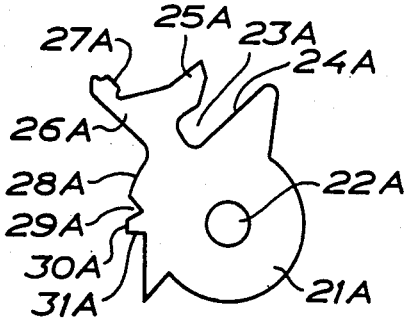
Figure 12B:
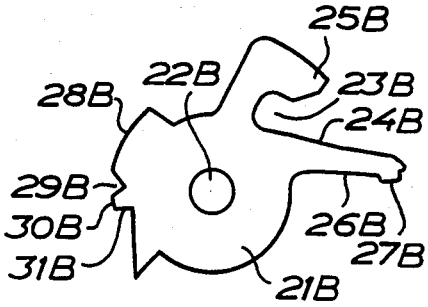
Figure 12C:
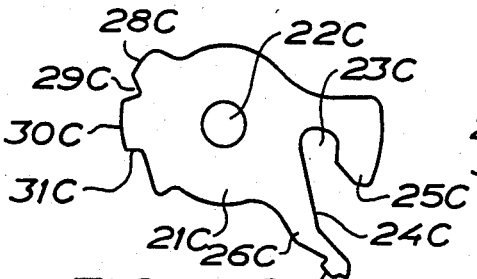
Figure 12D:
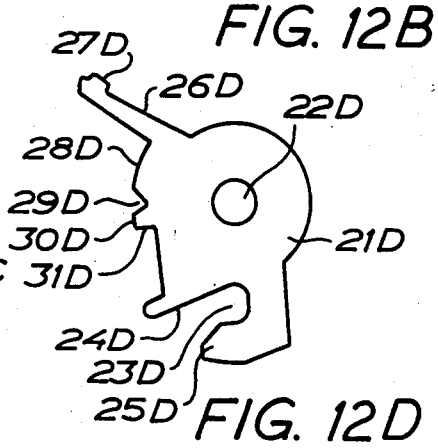
Figure 13:
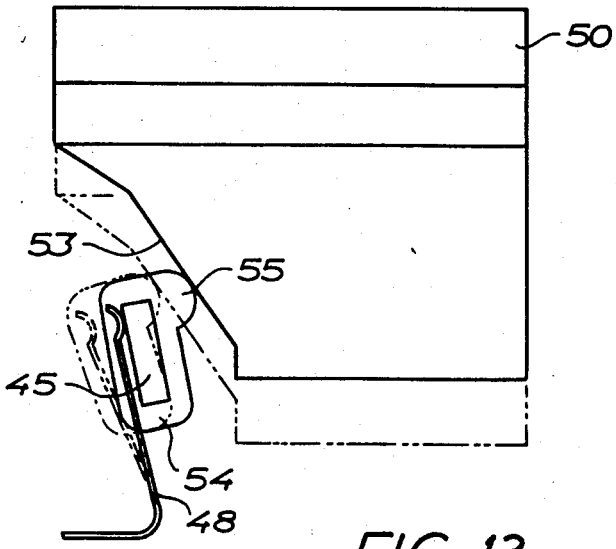

In order to explain the invention more clearly an embodiment thereof will be described in detail below, reference being made to the accompanying drawings in which FIG. 1 is a front view of the lock housing of the lock according to the invention in one embodiment thereof, FIG. 2 is a side view of the lock housing in FIG. 1 as seen from the right in FIG. 1, FIG. 3 is a front view of a chassis plate forming part of the lock housing, FIG. 4 is an enlarged front view partly broken away, of the lock housing in FIG. 1, FIG. 5 is a vertical sectional view of the lock housing in FIG. 4, FIG. 6 is a front view of a lock tongue of the lock, FIG. 7 is a side view of the lock tongue in FIG. 6, FIG. 8 is a fragmentary front view partly broken away, similar to FIG. 4 but with lock tongues inserted into the lock housing, FIG. 9 is a sectional view taken along line IX—IX in FIG. 8, FIG. 10 is a sectional view taken along line X—X in FIG. 8, FIG. 11 is a sectional view along line XI—XI in FIG. 8, FIGS. 12A–12D are plan views of four lock plates forming part of the lock, and FIG. 13 is a front view of the release member with the latch member co-operating therewith shown in vertical sectional view.

The lock comprises a lock housing 10 having an outer casing of plastic material which comprises two interconnected halves, a front half 11 and a rear half 12. Said casing halves can be interconnected in any conventional manner. Inside the casing, two chassis plates are provided, a front plate 13 and a rear plate 14, which are formed as shown in FIG. 3 with regard to the front plate. The rear plate 14 has a slotted lug as indicated by dot-and-dash lines 15 in FIG. 3 for the attachment of one hip strap portion, but otherwise the chassis plates are identical. Each chassis plate thus forms a central aperture 16 and four slots 17A–17D extending radially to the centre of said aperture, the slots 17A and 17B providing guide slots for lock tongues of two shoulder strap portions, the slot 17C providing a guide slot for the other hip strap portion, and the slot 17D providing a guide slot for a crotch strap portion which is provided sometimes but not always in vehicle belts for children. Each slot has a flared opening portion 18A–18D so as to facilitate the insertion of the lock tongue, and these slots should, of course, be available through openings in the edge wall of the casing. Thus, openings 19B and 19C are shown in FIG. 2 for the slots 17B and 17C. The two chassis plates are interconnected mutually spaced by a rivet 20, FIG. 11, and this rivet pivotally mounts four lock plates 21A–21D which are shown individually in FIGS. 12A–12D. The four lock plates are constructed to operate principally in the same manner but are differently shaped.

Referring to FIG. 12A, the lock plate shown therein comprises a central aperture 22A for mounting on the rivet 20. It forms a slot 23A the longitudinal edges of which provide an abutment surface 24A and a lock hook 25A. Furthermore, the lock plate forms a projection 26A having a guide stud 27A, and an edge surface portion 28A, a V-shaped notch 29A joining said portion, and an edge surface portion 30A, an edge shoulder 31A joining said latter portion. The mentioned details of the lock plate 21A are provided also by the other lock plates where corresponding reference numbers have been used together with the letter index of the related lock plate although the plates are shaped differently.

The lock plates 21A–21D mounted between the chassis plates 13 and 14 are pivoted about a common axis, viz. the pivot axis defined by the rivet 20, and the fitting thereof on the rivet and between the chassis plates allows the lock plates to be rotated easily. Each lock plate is biased by means of a spring, and this is shown with regard to the lock plate 21A in FIGS. 4 and 8 wherein a helical compression spring 32A is engaged between the projection 26A where the end of the spring is passed onto the guide stud 27A, and a spring support 33A forming part of the rear casing half 12. The lock plate 21A thus can be rotated clockwise from the position shown in FIG. 4 to the position shown in FIG. 8 against the bias of the helical spring 32A, and the other lock plates are mounted in the same manner although this is not shown in detail for each of the lock plates. As will be easily understood, the reason for the lock plates having different shapes is that they shall co-operate with lock tongues inserted into the lock housing from different directions, and that it is necessary considering the space in the lock housing to position the springs biasing the lock plates, at different locations in the lock housing. The lock plates have such a rotational position that in the respective position thereof corresponding to the position shown in FIG. 4 for the lock plate 21A they have the slot 23A–23D thereof in register with the corresponding slot 17A–17D in the lock plates 13 and 14. This position of the lock plate can be defined by a stationary abutment in the lock housing, a portion of the related lock plate being engaged with said abutment under the bias of the spring 32A, etc.

The lock tongues which are to co-operate with the lock housing described can be constructed according to FIGS. 6 and 7. As shown in these figures, the lock tongue is made of steel wire bent to form two slots 34 and 35 for passing through the strap, and an insert portion 36 forming an aperture 37 for engagement with one of the lock plates in the lock housing. A metal sheet clamp 38 provides an interconnecting element on the portions of the steel wire which is located between the two slots 34 and 35. It should be noted already here that the lock tongue can be constructed in other ways and can be made e.g. of steel sheet.

If it is assumed that a lock tongue is inserted e.g. into the lock tongue site defined by the slots 17A in the chassis plates 13 and 14, the end of the lock tongue portion 36 will hit the abutment surface 24A in the slot 23A formed by the lock plate 21A, FIG. 4. By the pressure of the lock tongue against the abutment surface 24A, the lock plate 21A will be rotated clockwise as seen in FIG. 4, the helical spring 32A being compressed and the condition according to FIG. 8 being reached. In this connection, confer also FIG. 11. However, in order to lock permanently the lock tongue in the lock housing, the lock plate must be latched in the position shown in FIG. 8 and in the lock of the invention this is achieved by a two step function; first the lock tongue is arrested temporarily in the position according to FIG. 8, then to be locked permanently in this position when all lock tongues have been engaged with the associated lock plates.

For temporarily arresting the lock plates there is provided in the lock housing an arresting element 39. This element can comprise a unitary body of any suitable plastic material and comprises a push button portion 40 projecting from the lock housing through a slot in the casing formed by the halves 10 and 11 as shown in FIG. 1, so that the push button portion 40 is available externally of the lock to be operated manually. The arresting element also forms four arresting fingers 41A–41D which together with the push button portion form substantially a V-shaped element which is pivotally mounted at a stud portion 42 at the tip of the V in apertures 43 in the two chassis plates 13 and 14 and is located between the chassis plates with each of the four fingers in register with one of the lock plates. The arresting element 30 is constructed such that the push button portion 40 and the fingers 41A–41D can be pressed elastically against each other. Each finger forms a sharp nose 44A–44D of such shape that it can be received by the notch 29A–29D of the respective lock plates 21A–21D. Immediately before the insertion of the lock tongues into the lock housing at the respective sides thereof the fingers 41A–41D are pressed at the noses 44A–44D thereof against the edge surface portions 28A–28D of the lock plates 21A–21D by manually depressing the push button portion 40. At such depression, the fingers and the push button portion will be moved resiliently against each other which is allowed by the elasticity of the arresting element 39 as mentioned above. Now that a lock tongue is inserted into the lock housing and effects clockwise rotation of the associated lock plate from the position in FIG. 4, the finger associated with the related lock plate will slide against the edge surface portion 28A, etc. at the nose thereof. In FIG. 8, the arresting element 39 is shown by solid lines in the non-operated position thereof. The push button portion 40 is shown by dash lines in the manually operated position, i.e. the depressed position, while the fingers are shown in one position by dot-and-dash lines and in another position by dash lines. If it is assumed that the finger shown in FIG. 4 is the finger 41B with the nose 44B, said finger co-operating with the lock plate 21B, the finger will take the position shown by dot-and-dash lines, which is designated 41B' in FIG. 8, when the finger at the nose thereof slides against the edge surface portion 28B at rotation of the lock plate 21B due to the insertion of the associated lock tongue and then will take the position shown by dash lines, which is designated 41B" in FIG. 8, when the nose snaps into the notch 29B, which is shown in FIG. 8. In the same manner as shown in FIG. 8 as far as the lock plate 21A is concerned, the lock plate 21B in this position of the lock plate 21B engages at the hook 25B thereof the associated lock tongue. As the lock tongues are inserted into the lock housing one after the other, the lock plates will be arrested in the manner described by means of the fingers of the arresting element 39 as long as the arresting element is kept depressed at the push button portion 40. However, as soon as the push button portion is released, all lock plates would return to the rest positions thereof under the bias of the associated springs, and in order to prevent this and provide a permanent retainment of the lock tongues in the lock housing, a latch member 45 is provided.

The latch member 45 comprises a bar which is pivotally mounted in an aperture 46 in each of the two chassis plates 13 and 15 and spans the distance between the chassis plates. A border edge of the apertures 46 forms a cam 47 at which the latch member 45 is supported when pivoted in the apertures 46. The latch member is biased by means of a leaf spring 48 which is attached to the lock housing at 49 and engages the bar to bias the bar continuously against the lock plates 21A–21D, the latch member engaging the edge surface portions 30A–30D, FIG. 4. The latch member 45 is dimensioned and positioned such that the top edge thereof will be located below the shoulder 31A, etc. of the lock plates when the lock plates have been rotated clockwise from the position according to FIG. 4 to the arrested position according to FIG. 8. As long as one of the lock plates has not been rotated to the position according to FIG. 8, the latch member 45 will be maintained in the position according to FIG. 4 against the bias of the spring 48, because the latch member engages the edge surface portion 30A, etc. of the related lock plate. However, when all lock plates have reached the position according to FIG. 8 and are kept arrested in this position, the spring 48 is no longer prevented from pivoting the latch member to the position of FIG. 8 wherein the latch member is located below the shoulders 31A–31D. If the arresting element 39 is now released, it will return to the position shown by solid lines (possibly it can be slightly biased towards this position), the lock plates 21A–21D being rotated clockwise under the bias of the springs 32A–32D so as to engage the shoulders 31A–31D with the latch member 45. Thus, the lock tongues are now permanently locked in the lock housing by means of the respective lock plates.

For releasing the lock tongues when the belt is to be put out of use there is displaceably guided in the front casing half 10 a release button which is shown separately in FIG. 13. This release button is biased by means of a helical pressure spring 51 which is guided on a pin 52 formed by the release button and is engaged between the release button and a support formed by the casing half 10. The release button forms an inclined surface 53, and on the latch member 45 there is provided a plastic body 54 moulded onto said member, which is kept engaged with the inclined surface 53 under the bias of the spring 48 at a curved nose 55. When the push button is maintained in the upper position thereof by means of the pressure spring 51, the inclined surface 53 is positioned in relation to the nose 55 such that the latch member 45 can engage the shoulders 31A–31D, but by depression of the release button 50 against the bias of the pressure spring 51 to the position shown by dot-and-dash lines in FIG. 13, the latch member 45 by co-operation between the inclined surface 53 and the nose 55 will be pivoted against the bias of the spring 48 to the position shown by dot-and-dash lines in FIG. 13 so that the latch member will be disengaged from the shoulders 31A–31D and the lock plates 21A–21D can return to the positions according to FIG. 4 under the bias of the respective springs 32A–32D thereof. Then, the hooks 25A–25D disengage the associated lock tongues which, moreover, will be ejected from the lock housing by the abutment surfaces 24A–24D at counter-clockwise movement of the lock plates as seen in FIG. 8.

Thus, it will be seen from the description above that the lock of the invention will arrive at the locked position only if all lock tongues are inserted into the lock housing, the attainment of the locked position being indicated by a loud click when the latch member 45 snaps to engaged position at the shoulders 31A–31D. Moreover, it will be seen that all lock tongues are released and ejected simultaneously when the release button 50 is operated. As a consequence thereof the lock of the invention satisfies the requirements now established for belt locks of the type referred to herein, and although the function of the lock may appear to be complicated, the construction of the lock is relatively simple, because the elements thereof are of a non-complicated and easily manufactured construction. E.g. the chassis plates and the lock plates can be made by stamping, which is true also for the latch member 45. The remaining details as far as they are not standard items such as springs and rivets, can be made by injection moulding of plastic material. Modifications can of course be made as far as the construction is concerned without departing from the inventive concept as defined in the accompanying claims.

In some cases, the fifth strap portion is not provided, i.e. the portion to be connected to the lock housing at the bottom thereof, and in that case the lock can be constructed as described and a dummy plug 56 can be inserted into the lock housing at the bottom thereof, replacing a lock tongue. The dummy plug has a lock tongue portion 57 maintaining the associated lock plate 21D engaged with the lock tongue portion, and the dummy plug is attached to the lock housing by snap action at engagement portions 58 so as to maintain the lock plate 21D permanently in said position. Thus, this lock plate can be said to be neutralized as far as the function thereof is concerned, and the other lock plates can function as described with regard to the three other lock tongues.

Preferably, the edge surface portions 28A–28D and 30A–30B are formed with one and the same radius.

I claim:

1. Lock for safety belts having at least two hip strap portions and at least one further strap portion, said lock including a lock housing to be attached to one hip strap portion; a lock mechanism enclosed by said casing; and a lock tongue on each of the other hip strap portion and said further strap portion, or each further strap portion, respectively, which can be inserted into the lock housing for cooperation with the lock mechanism, said lock mechanism comprising a number of lock plates one for each lock tongue, which are mounted in the lock housing for pivotal movement about a common axis and each form an abutment for the associated lock tongue and a hook for retaining locking engagement with the lock tongue, first spring means biasing each of the lock plates out of engagement with the associated lock tongue, the hook of the lock plate being engaged with the lock tongue against the spring bias when the lock tongue is inserted into the lock housing to be engaged with the abutment, an arresting element for each lock plate to be engaged therewith to arrest temporarily the lock plate in the engaged position, manually operable means for actuating the arresting elements to engagement with the associated lock plates, a latch member, second spring means biasing the latch member to engage the lock plates when all lock plates are temporarily arrested in the engaged position, to retain permanently the lock plates in said position, and a manually operable release member for actuating the latch member against the spring bias thereof to release the lock plates and allow pivotal movement thereof under the spring bias of the lock plates, to release the respective lock tongues from the lock mechanism.

2. Lock as claimed in claim 1 wherein each lock plate forms a notch in the edge thereof for engagement of the arresting element which can be elastically contacted with the edge of each lock plate to engage said notch in the engaged position of the lock plate.

3. Lock as claimed in claim 2 wherein the arresting element can be contacted with edge portions of the lock plates, allowing rotation of the lock plates in relation to the latch member, said notch in each lock plate joining said edge portion.

4. Lock as claimed in claim 3 wherein the arresting element comprises a unitary body to be operated manually from the outside of the lock by said manually operable release member, said body forming for each lock plate a resilient finger for cooperation with said edge portion and the notch joining the edge portion of the associated lock plate.

5. Lock as claimed in claim 1 wherein each lock plate forms a slot for receiving the associated lock tongue therein.

6. Lock as claimed in claim 5 wherein one of the longitudinal edges of the slot forms said shoulder and the other one of said edges forms said hook.

7. Lock as claimed in claim 1 wherein each lock plate forms an edge shoulder, the latch member engaging behind said edge shoulder to retain the lock plate in the engaged position thereof.

8. Lock as claimed in claim 7 wherein the latch member under the spring bias thereof engages edge portions of the lock plates allowing pivotal movement thereof in relation to the latch member, the edge shoulder of each lock plate joining said edge portion.

9. Lock as claimed in claim 1 wherein the lock housing comprises two mutually spaced parallel chassis plates and wherein the lock plates are mounted between said chassis plates.

10. Lock as claimed in claim 9 wherein the chassis plates form a guide slot for each lock tongue.

11. Lock as claimed in claim 9 wherein the latch member is pivotally mounted in the chassis plates.

* * * * *